US008317153B2

(12) United States Patent
Pelc et al.

(10) Patent No.: US 8,317,153 B2
(45) Date of Patent: Nov. 27, 2012

(54) STOP ELEMENT FOR CONTACTING AND POSITIONING A FORMWORK

(75) Inventors: Thomas Pelc, Oberriet (CH); Thomas Foser, Balzers (LI)

(73) Assignee: Hilti Aktiengesellschaft, Schaan (LI)

( * ) Notice: Subject to any disclaimer, the term of this patent is extended or adjusted under 35 U.S.C. 154(b) by 160 days.

(21) Appl. No.: 12/846,178

(22) Filed: Jul. 29, 2010

(65) Prior Publication Data

US 2011/0024603 A1 Feb. 3, 2011

(30) Foreign Application Priority Data

Jul. 30, 2009 (DE) ..... 10 2009 028 119

(51) Int. Cl.
*E04G 17/14* (2006.01)

(52) U.S. Cl. ..... 249/210; 249/207

(58) Field of Classification Search ..... 249/207, 249/210; *E04G 17/14*
See application file for complete search history.

(56) References Cited

U.S. PATENT DOCUMENTS

| | | | | |
|---|---|---|---|---|
| 1,446,195 | A | 2/1923 | McHale | |
| 1,699,557 | A * | 1/1929 | Yeager | 52/365 |
| 2,182,579 | A * | 12/1939 | Bolton et al. | 52/370 |
| 4,924,648 | A * | 5/1990 | Gilb et al. | 52/295 |
| 5,125,616 | A * | 6/1992 | Rothenbuehler et al. | 249/3 |
| 7,770,866 | B2 * | 8/2010 | Ferro De La Cruz | 249/216 |

FOREIGN PATENT DOCUMENTS

| | | |
|---|---|---|
| DE | 39 31 831 | 4/1991 |
| DE | 102 11 495 | 9/2003 |
| DE | 20 2009 006 026 | 7/2009 |

* cited by examiner

*Primary Examiner* — Michael Safavi
(74) *Attorney, Agent, or Firm* — Leydig, Voit & Mayer, Ltd.

(57) ABSTRACT

The invention relates to a stop element with a stop for contact of a formwork element on the stop element, an abutment for contact with a fixation element, a bottom support for contact of the stop element on an underlying surface, and a support foot for bracing the stop element on the underlying surface, wherein the support foot has a reinforcement rib.

19 Claims, 3 Drawing Sheets

STOP ELEMENT FOR CONTACTING AND POSITIONING A FORMWORK

TECHNICAL FIELD

The invention pertains to a stop element with a stop for contacting a formwork element with the stop element.

PRIOR ART

Such stop elements are typically fixed to an underlying surface, so that formwork walls or the like can then be contacted with the stop element and thereby easily positioned and oriented. For this purpose, stop elements typically have a base with which they rest on the underlying surface, as well as a generally cylindrical peripheral wall that serves as a stop surface for a formwork wall.

A disadvantageous aspect is an insufficient filling of the narrow gap between such a peripheral wall and the formwork wall with liquid concrete.

PRESENTATION OF THE INVENTION

The problem of the invention is to provide a stop element with which an intermediate space between the stop element and a formwork wall can be better filled with liquid concrete.

The problem is solved by a stop element with a stop for contact of a formwork element with the stop element, an abutment for contact with a fixation element, a bottom support for contact of the stop element on an underlying surface, and a support foot for bracing the stop element on the underlying surface, wherein the support foot has a reinforcement rib that projects from the support foot spaced away from the stop and deviates from a center-of-gravity plane that is spanned by the centers of gravity of the abutment, the bottom support, and the support foot.

According to a preferred embodiment, the support foot has a bearing surface for bracing on the underlying surface. It is particularly preferred if the reinforcement rib reaches to the bearing surface.

According to a preferred embodiment, the support foot has two reinforcement ribs projecting from the support foot spaced away from the stop and deviate from the center-of-gravity plane. It is particularly preferred if the two reinforcement ribs project from the support foot on different sides of the center-of-gravity plane.

According to a preferred embodiment, the stop is formed by an end face of a web.

According to another preferred embodiment, the stop is formed by an edge.

According to another preferred embodiment, the stop is formed in a substantially punctiform manner, in particular, by a projecting corner.

According to another preferred embodiment, the stop is formed on the support foot.

According to a preferred embodiment, the support foot has a support rib that projects from the support foot parallel to the center-of-gravity plane.

According to a preferred embodiment, the support rib has a greater thickness than the support foot without the reinforcement rib or ribs.

According to a preferred embodiment, the support foot has a bearing surface for bracing on the underlying surface. It is particularly preferred if the support rib is separated from the bearing surface.

According to a preferred embodiment, the stop element has a bottom element separate from the stop. It is particularly preferred if the bottom element connects the bottom support to the support foot.

According to a preferred embodiment, the bottom element extends up to the reinforcement rib.

According to a preferred embodiment, the bottom element, together with two support feet, forms a semi-channel that can be covered by means of an underlying surface contacting the bottom support and/or a formwork element contacting the stop in order to form a flow channel for a liquid, in particular, liquid concrete.

According to a preferred embodiment, the stop element has stabilization elements that project from the bottom element on the side facing away from the bearing surface and/or the bottom support, wherein recesses, in particular passageways, are left between the stabilization elements.

EMBODIMENTS

The invention will be described below in detail on the basis of embodiments with reference to the appended drawings. Therein:

Figure 1:
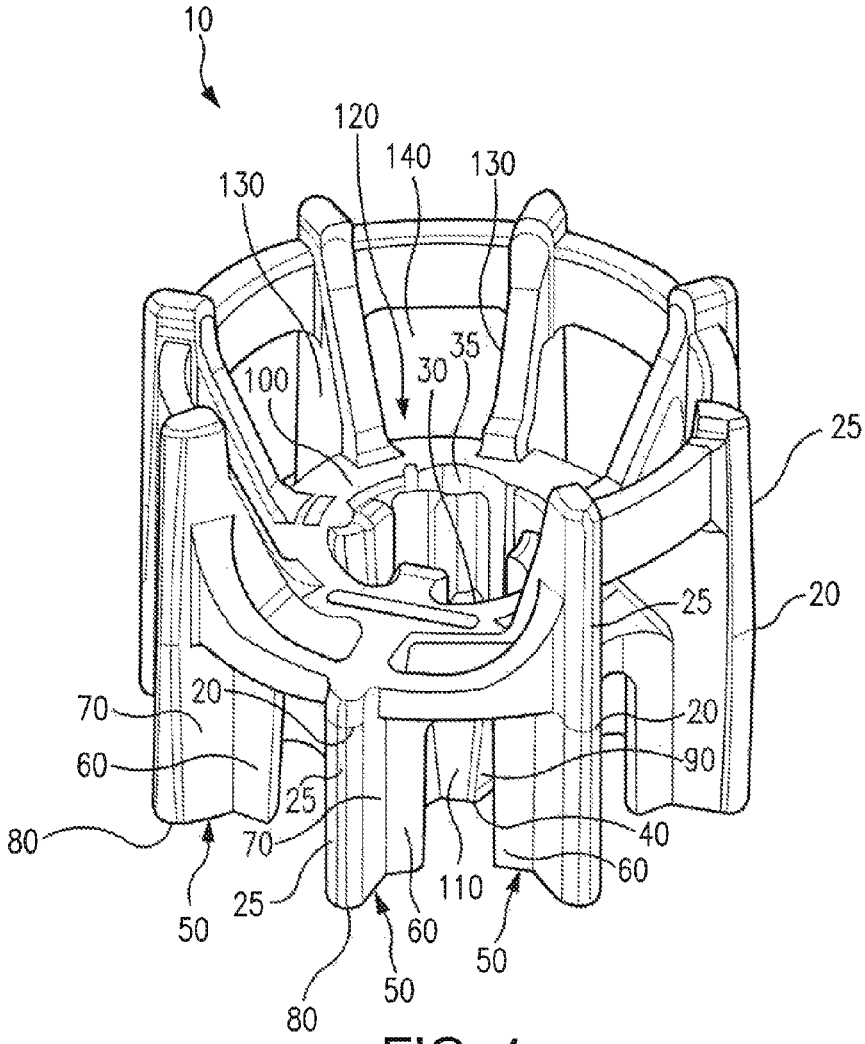
FIG. 1 shows a stop element in an oblique view.

A stop element 10 is shown in an oblique view in FIG. 1. The stop element 10 has several stops 20 for contacting a formwork element, not shown, with stop element 10. The stops 20 are formed in essentially a punctiform manner on the edges 25, in that the stop element tapers down from the stops 20 in both directions along the edges 25, so that the edges 25 each have an oblique angle that forms the respective stop 20. In an embodiment that is not shown, the stops are formed in a substantially linear manner as edges. In other embodiments, not shown, the stops are formed in two dimensions and/or as end faces of webs.

The stop element 10 further comprises an abutment 30 for contact with a fixation element, not shown, for example a nail, a screw, a bolt or the like. The abutment 30 is preferably formed as an annular surface that surrounds a guide 35 for the fixation element preferably extending all the way through the stop element 10. In embodiments that are not shown, the guide is configured as a blind hole or as a groove on an edge of the stop element. In the embodiment shown, the abutment 30 serves as a contact surface for a head or the like of the fixation element. In additional embodiments that are not shown, the abutment is constructed two-dimensionally or substantially in a linear or punctiform manner and serves as a contact surface for a nail head, a screw head, a bracket or a similar fixation element.

The stop element 10 further comprises a bottom support 40 for contact of the stop element on an underlying surface, not shown. The bottom support 40 is configured as a contact surface of which only a boundary edge is visible in FIG. 1. In embodiments that are not shown, the abutment is constructed substantially in a linear or punctiform manner. The guide 30 preferably opens into the bottom support 40, especially preferably into its center of gravity.

The stop element 10 further comprises support feet 50 for bracing the stop element 10 on the underlying surface, not shown, so that a risk of undesired tipping of the stop element 10 is reduced. The support feet 50 have reinforcement ribs 60 that project from the support foot 50 spaced away from the respective stop 20, due to the webs 70, and deviate from the center-of-gravity plane spanned by the centers of gravity of the abutment 30, the bottom support 40, and the respective support foot 50. The center of gravity of the abutment 30 is situated in FIG. 1 in the upper opening of the guide 35, whereas the center of gravity of the bottom support is situated in the lower opening of the guide 35 in FIG. 1. Due to the deviation from the respective center-of-gravity plane, the danger of an undesired lateral buckling of the support feet in certain circumstances is reduced. As is visible in FIG. 1, two reinforcement ribs 60 project from each support foot 50 on different sides of the respective center-of-gravity plane.

As can be seen in FIG. 1, the reinforcement ribs 60 not only project from the support feet 50 spaced away from the respective stops 20, but are in fact spaced away from the stops 20 in their entirety. According to embodiments that are not shown, one or more reinforcement ribs project from the respective support feet spaced away from the respective stops, but themselves comprise stops for contact with a formwork wall. The support feet then have, for example, an X-shaped cross-section or an X-shaped cross-section extended by a central web. In additional embodiments that are not shown, the reinforcement ribs 60 shown in FIG. 1 are omitted, so that the support feet have a Y-shaped cross-section with reinforcement ribs that point at an angle outward and whose outer edges form or comprise the stops.

The support feet each have a bearing surface 80 for bracing on the underlying surface. Only boundary edges of the bearing surfaces 80 can be seen in FIG. 1. The reinforcement ribs 60 each run up to the bearing surface 80 of the respective support foot 50. In an embodiment that is not shown, however, one or more reinforcement ribs are spaced away from the respective bearing surface.

According to the embodiment shown in FIG. 1, the support feet each have a support rib 90 that projects from the respective support foot 50 parallel to and, in particular, inside the center-of-gravity plane. The support ribs 90 each have a greater thickness than the respective support foot 50, the thickness of the support foot 50 being calculated without its reinforcement ribs. The support ribs 90 are preferably spaced away from the bearing surfaces 80 of the respective support feet 50. In embodiments that are not shown, the support ribs each have a thickness that is less than or equal to the thickness of the respective support foot and/or extend up to the bearing surface.

The support element further 10 comprises a bottom element 100 spaced away from the stops 20. The bottom element 100 connects the bottom support 40 to the support feet 50 via a connection sleeve 110 constructed, in particular, as a cone. The bottom element 100 extends up to the reinforcement ribs 60 and forms, together with two respective support feet 50, a semi-channel 120 that can be closed off by means of an underlying surface contacting the bottom support 40 and/or a formwork element contacting one or more of the adjacent stops 20, in order to form a flow channel for a liquid, in particular, liquid concrete. The concrete then flows centrally from the top in FIG. 1 towards the stop element 10, then flows at an incline downwards through the flow channel and along the formwork wall and finally along the underlying surface into the volume formed between the support ribs 90. After hardening of the concrete and removal of the formwork wall, the support element 10 is completely or almost completely surrounded by concrete and thus no longer recognizable or recognizable only based on the stops 20.

The stop element 10 further comprises stabilization elements 130 that project from the bottom element 100 on the side facing away from the bearing surfaces 80 and the bottom support 40, with passages 140 being left between the stabilization elements 130. The passages 140 are preferably wider than the stabilization elements 130 and likewise serve to pass a flow of liquid, in particular liquid concrete. The stabilization elements 130 are also preferably connected to one another by means of connecting webs 150, so that their stabilizing effect is increased.

The stop element 10 is preferably produced from plastic, and particularly preferably as a one-piece injection-molded part. In embodiments that are not shown, on the other hand, the stop element is composed of several parts and/or of a different material such as a metal or an alloy.

Figure 2:
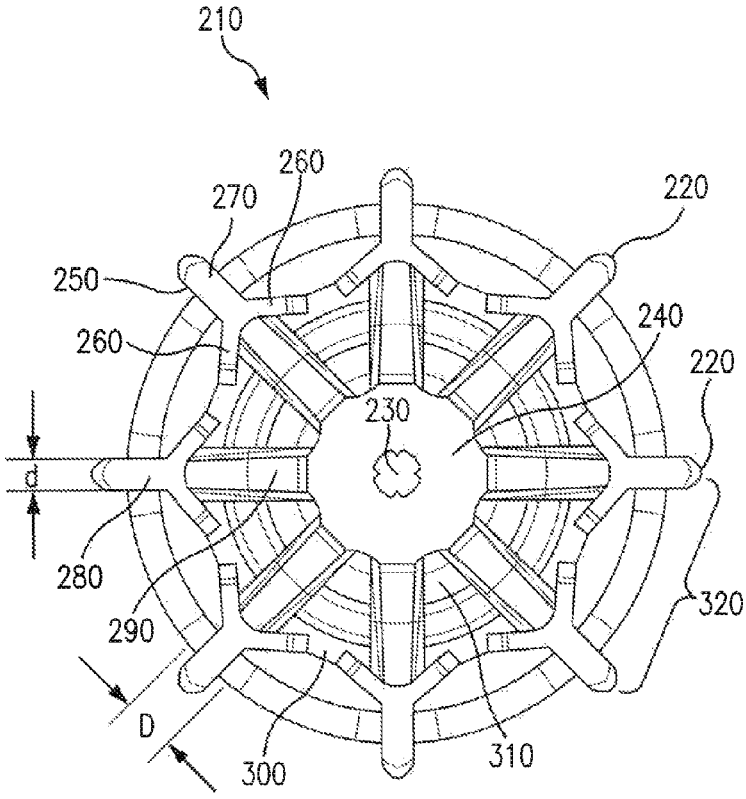
FIG. 2 shows a stop element in a plan view.

A stop element 210 is shown in a plan view in FIG. 2. The stop element 210 has several stops 220 for contacting a formwork element, not shown, with stop element 210. The stops 220 are constructed substantially linearly as edges. The stop element 210 further comprises an abutment, not shown, for contact with a fixation element, in particular, a nail, a screw, a bolt or the like.

The stop element 210 further comprises a bottom support 240 for contact of the stop element on an underlying surface, not shown. The bottom support 240 is constructed as an annular contact surface, with a guide 230 for the fixation element opening in the center of this annular contact surface.

The stop element 210 further comprises support feet 250 for bracing the stop element 210 on the underlying surface, not shown, so that a risk of undesired tipping of the stop element 210 is reduced. The support feet 250 have reinforcement ribs 260 that project from the support foot 250 spaced away from the respective stop 220, due to the webs 270, and deviate from the center-of-gravity plane spanned by the centers of gravity of the abutment, the bottom support 240, and the respective support foot 250. The center of gravity of the abutment 30 is situated in FIG. 2 behind the shown opening of the guide 235, whereas the center of gravity of the bottom support is situated in the opening of the guide 235. As is visible in FIG. 2, two reinforcement ribs 260 project from each support foot 250 on different sides of the respective center-of-gravity plane.

The support feet each have a bearing surface 280 for bracing on the underlying surface. The reinforcement ribs 260 each extend up to the bearing surface 280 of the respective support foot 250, so that the Y-shaped outline of each of the bearing surfaces 280 shown in FIG. 2 results. According to the embodiment shown in FIG. 2, the support feet each have a support rib 290 that projects from the respective support 250 inside the center-of-gravity plane. The support ribs 290 each have a greater thickness D than the thickness d of the respective support foot 250. The support ribs 290 are preferably spaced away from the bearing surfaces 280 of the respective support feet 250.

The support element further 210 comprises a bottom element 300 spaced away from the stops 220. The bottom element 300 connects the bottom support 240 to the support feet 250 via a connection sleeve 310 constructed as a cone. The bottom element 300 extends up to the reinforcement ribs 260 and forms, together with two respective support feet 250, a semi-channel 320 that can be closed off by means of an underlying surface contacting the bottom support 240 and/or a formwork element contacting one or more of the adjacent stops 220, in order to form a flow channel for liquid concrete.

Figure 3:
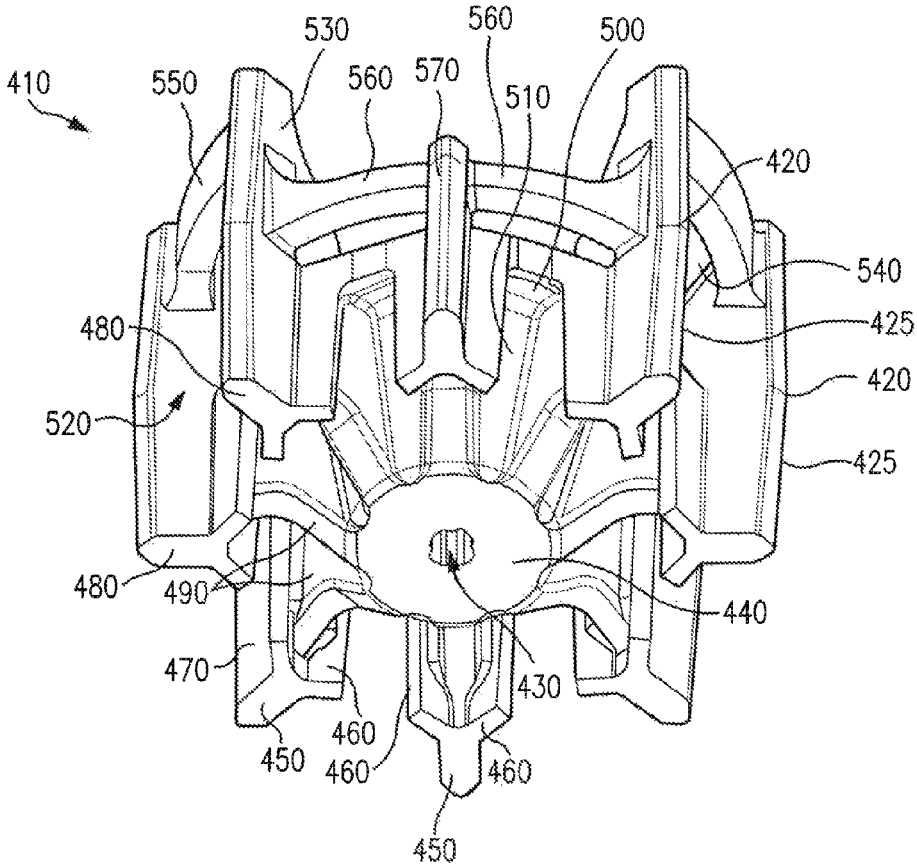
FIG. 3 shows a stop element in an oblique view.

A stop element 410 is shown in an oblique view in FIG. 3. The stop element 410 has several stops 420 for contacting a formwork element, not shown, with stop element 410. The stops 420 are formed in essentially a punctiform manner on the edges 425, in that the stop element tapers down from the stops 420 in both directions along the edges 425, so that the edges 425 each have an oblique angle that forms the respective stop 420. The stop element 410 further comprises an abutment, not shown, for contact with a fixation element such as a nail, a screw, a bolt or the like. The stop element 410 further comprises a bottom support 440 for contact of the stop element 410 on an underlying surface, not shown. The bottom support 440 is constructed as an annular contact surface, with a guide 430 opening in the center of gravity of this annular contact surface.

The stop element 410 further comprises support feet 450 for bracing the stop element 410 on the underlying surface, not shown, so that a risk of undesired tipping of the stop element 410 is reduced. The support feet 450 have reinforcement ribs 460 that project from the support foot 450 spaced away from the respective stop 420, due to the webs 470, and deviate from the center-of-gravity plane spanned by the centers of gravity of the abutment, the bottom support 440, and the respective support foot 450. Due to the deviation from the respective center-of-gravity plane, the danger of an undesired lateral buckling of the support feet in certain circumstances is reduced. As is visible in FIG. 3, two reinforcement ribs 460 project from each support foot 450 on different sides of the respective center-of-gravity plane.

The support feet 450 each have a bearing surface 480 for bracing on the underlying surface. The reinforcement ribs 460 each run up to the bearing surface 480 of the respective support foot 450. According to the embodiment shown in FIG. 3, the support feet 450 each have a support rib 490 that projects from the respective support 450 inside the center-of-gravity plane. The support ribs 490 each have a greater thickness than the respective support foot 450. The support ribs 490 are preferably spaced away from the bearing surfaces 480 of the respective support feet 450.

The support element further 410 comprises a bottom element 500 spaced away from the stops 420. The bottom element 500 connects the bottom support 440 to the support feet 450 via a connection sleeve 510. The bottom element 500 extends up to the reinforcement ribs 460 and forms, together with two respective support feet 450, a semi-channel 520 that can be closed off by means of an underlying surface contacting the bottom support 440 and/or a formwork element contacting one or more of the adjacent stops 420, in order to form a flow channel for liquid concrete.

The stop element 410 further comprises stabilization elements 530 that project from the bottom element 500 on the side facing away from the bearing surfaces 480 and the bottom support 440, with passages 540 being left between the stabilization elements 530. The passages 540 are preferably wider than the stabilization elements 530 and likewise serve to pass liquid concrete. The stabilization elements 530 are also connected to one another by means of connecting webs 550, so that their stabilizing effect is increased. Two of the connecting webs 560 and, with them, an upper edge of the stabilization element 570 arranged between them are arranged offset towards the side of the bottom support 440 and the bearing surfaces 480 relative to the other connecting webs 550, in order to allow better accessibility of the guide 430 for a tool, not shown, such as a setting device, particularly one with a laterally projecting fixation element magazine.

As follows from the figures, a symmetrical shape is preferred for the stop element. The stop elements that are shown each have support feet arranged at angular intervals of 45° around a central guide. In embodiments that are not shown, the stop elements have fewer than eight, for instance, two, three, four, five or six support feet, or more than eight, for example, nine, ten or twelve support feet. The stop elements that are shown each have eight stops arranged at angular intervals of 45° around a central guide; a formwork wall can be placed against a respective stop or two adjacent stop. In embodiments that are not shown, the stop elements have fewer than eight, for instance, two, three, four, five or six stops, or more than eight, for example, nine, ten or twelve stops.

The invention was described with respect to a stop element for formwork walls of concrete formwork. The characteristics of the described embodiment can also be combined as desired with one another inside a single stop element. It is pointed out that the stop element according to the invention is also suited for other purposes.

The invention claimed is:

1. A stop element comprising stops for contact of a formwork element on the stop element, an abutment for contact with a fixation element, the abutment having a center of gravity; a bottom support for contact of the stop element on an underlying surface, the bottom support having a center of gravity; reinforcement ribs; and support feet for bracing the stop element on the underlying surface, the support feet each having a bearing surface, the bottom support and the bearing surfaces defining a common plane, the support feet having a center of gravity, wherein the reinforcement ribs project from the support feet and the reinforcement ribs are spaced away from the stops and deviate from a center-of-gravity plane that is spanned by the centers of gravity of the abutment, the bottom support, and the support feet.

2. The stop element of claim 1, wherein the reinforcement ribs extend up to the bearing surfaces.

3. The stop element of claim 1, wherein two reinforcement ribs project from each support foot spaced away from the stop and the reinforcement ribs deviate from the center-of-gravity plane.

4. The stop element of claim 3, wherein the two reinforcement ribs project from the support foot on different sides of the center-of-gravity plane.

5. The stop element of claim 1, comprising a web, wherein the web spaces the reinforcing ribs and support feet from the stops.

6. The stop element of claim 1, wherein the support feet with the reinforcement ribs projecting therefrom have a Y-shaped or X-shaped cross section.

7. The stop element of claim 1, wherein the stops are formed in a substantially punctiform manner.

8. The stop element of claim 1, wherein the support feet extend from the stops.

9. The stop element of claim 1, further comprising support ribs, wherein the support ribs project from the support feet parallel to the center-of-gravity plane.

10. The stop element of claim 1, wherein the reinforcement rib is spaced away from the bearing surface.

11. The stop element of claim 1, wherein, spaced away from the stops, the stop element has a bottom element that connects the bottom support to the support feet.

12. The stop element of claim 11, wherein the bottom element extends up to the reinforcement ribs.

13. The stop element of claim 11, wherein the bottom element, together with two support feet, forms a semi-channel that can be covered by means of an underlying surface contacting the bottom support and/or a formwork element contacting the stop, in order to form a flow channel for a liquid.

14. The stop element of claim 11, wherein the stop element has stabilization elements that project from the bottom element on the side facing away from the bearing surface and/or the bottom support, wherein recesses are left between the stabilization elements.

15. The stop element of claim 12, wherein the bottom element, together with two support feet, forms a semi-channel that can be covered by means of an underlying surface contacting the bottom support and/or a formwork element contacting the stop, in order to form a flow channel for a liquid.

16. The stop element of claim 12, wherein the stop clement has stabilization elements that project from the bottom element on the side facing away from the bearing surface and/or the bottom support, wherein recesses are left between the stabilization elements.

17. The stop element of claim 13, wherein the stop element has stabilization elements that project from the bottom element on the side facing away from the bearing surface and/or the bottom support, wherein recesses are left between the stabilization elements.

18. The stop element of claim 7, wherein the stops are formed in a substantially punctiform manner by projecting corners.

19. A stop element comprising a stop for contact of a formwork element on the stop element, an abutment for contact with a fixation element, the abutment having a center of gravity; a bottom support for contact of the stop element on an underlying surface, the bottom support having a center of gravity; a reinforcement rib; and a support foot for bracing the stop element on the underlying surface, the support foot having a center of gravity, wherein the reinforcement rib projects from the support foot and the reinforcement rib is spaced away from the stop and deviates from a center-of-gravity plane that is spanned by the centers of gravity of the abutment, the bottom support, and the support foot; the stop element further comprising a support rib, wherein the support rib projects from the support foot parallel to the center-of-gravity plane, wherein the support rib has a greater thickness than a support foot without the reinforcement rib.

* * * * *